US005568020A

United States Patent [19]

Kaneko et al.

[11] Patent Number: 5,568,020

[45] Date of Patent: Oct. 22, 1996

[54] RINGING FREE DEFLECTION YOKE

[75] Inventors: Kenji Kaneko, Iwai; Takashi Takemoto, Mitsukaidou, both of Japan

[73] Assignee: Victor Company of Japan, Ltd., Yokohama, Japan

[21] Appl. No.: 325,707

[22] Filed: Oct. 19, 1994

[30] Foreign Application Priority Data

Oct. 20, 1993 [JP] Japan ..... 5-285863

[51] Int. Cl.[6] ..... G09G 1/04; H01J 29/56; H01H 1/00

[52] U.S. Cl. ..... 315/370; 315/399; 335/213

[58] Field of Search ..... 315/399, 370, 315/395; 335/210, 213

[56] References Cited

U.S. PATENT DOCUMENTS 4,232,253 11/1980 Mortelmans et al. ..... 315/370

5,008,600 4/1991 Hashimoto et al. ..... 315/370

5,039,922 8/1991 Ogasa et al. ..... 215/370

FOREIGN PATENT DOCUMENTS 62-281242 12/1987 Japan .

*Primary Examiner*—Gregory C. Issing

*Attorney, Agent, or Firm*—Michael N. Meller

[57] ABSTRACT

An intermediate tap 31 is provided on a vertical deflection coil 22 of a deflection yoke and the intermediate tap is connected to a chassis ground through a high-pass filter 32 which can pass only a ringing current to form a current path, thereby the the ringing current is prevented from passing through the vertical deflection coil 22 so that the raster ringing is substantially reduced.

6 Claims, 4 Drawing Sheets

RINGING FREE DEFLECTION YOKE

BACKGROUND OF THE INVENTION

1. Field of the Invention

The present invention relates to a deflection yoke capable of substantially reducing raster ringing (undulations of scanning lines on a TV raster screen) and hence obtaining a high reproduced image quality.

2. Description of the Prior Art

Deflection yokes capable of preventing raster ringing which is a source of degradation of image quality, have been proposed. Typical examples of the proposed prior arts of such are shown in Japanese Patent Application Laid-open Nos. 61-104544/1986 and 62-281242/1987, which will be described, first, with reference to FIG. 6 which shows an equivalent circuit of a horizontal deflection coil of such prior art.

According to the analysis of raster ringing in 61-104544/1986, distributed capacitances (unbalanced capacitances) C and C' in an upper coil 1*a* and a lower coil 1*b* of a horizontal deflection coil 1 are charged with a horizontal deflection current (horizontal pulse) and consequently currents I1, I2 and I1', I2' flow through the coils 1*a* and 1*b*. Ringing magnetic field oscillates by charging and discharging of the unbalanced capacitances C and C', resulting in raster ringing.

In order to prevent such raster ringing, 61-104544/1986 proposes a provision of intermediate taps 10*c* and 10*d* on the respective upper and lower coils 1*a* and 1*b* of the horizontal deflection coil 1 to which capacitors 11 and 12 whose capacitances Cx and Cx' are equivalent to the unbalanced capacitances C and C', respectively, are connected as shown in FIG. 7 to balance the distributed capacitance over the coils 10*a* and 10*b* to thereby reduce the raster ringing.

According to the analysis of raster ringing in 62-281242/1987, a cross-talk occurs from a horizontal deflection coil to a vertical deflection coil when a frequency of a horizontal deflection current is high and a distributed capacitance of the vertical deflection coil is charged with a voltage induced in the vertical deflection coil due to this cross-talk. Due to charge/discharge of the distributed capacitance, an oscillating current flows therethrough to generate a ringing magnetic field, resulting in raster ringing.

In order to prevent such cross-talk and hence raster ringing from occurring, 62-281242/1987 proposes to provide an electrostatic shield between the horizontal deflection coil and the vertical deflection coil and connect an element which can cut-off a horizontal deflection signal component supplied to the horizontal deflection coil in series with the vertical deflection coil.

Despite these prior art propositions, raster ringing is neither prevented nor sufficiently reduced as yet.

SUMMARY OF THE INVENTION

An object of the present invention is to provide a deflection yoke capable of substantially reducing raster ringing and hence obtaining a high reproduced image quality.

According to the present invention, the above object can be achieved by providing a deflection yoke including a horizontal deflection coil and a vertical deflection coil, characterized by comprising at least one intermediate tap provided on the vertical deflection coil and an element capable of passing a current having a frequency component higher than the maximum frequency component of vertical deflection current flowing through the vertical deflection coil, provided between the intermediate tap and a ground.

DETAILED DESCRIPTION OF THE PREFERRED EMBODIMENT

Before describing embodiments of the present invention in detail, the background of the present invention will be described. The present inventors considered that raster ringing is not sufficiently reduced by the conventional technology since it is caused by other reasons than those studied previously. As a result of lengthy study of source of raster ringing, the present inventors have found one of major sources of raster ringing which will be described with reference to FIG. 2 which shows an impedance characteristics of a horizontal deflection coil, and FIG. 3 which shows a model of deflection yoke for explaining the major source of raster ringing. As is clear from FIG. 3, the deflection yoke includes a horizontal deflection coil 21 and a vertical deflection coil 22.

Figure 2:
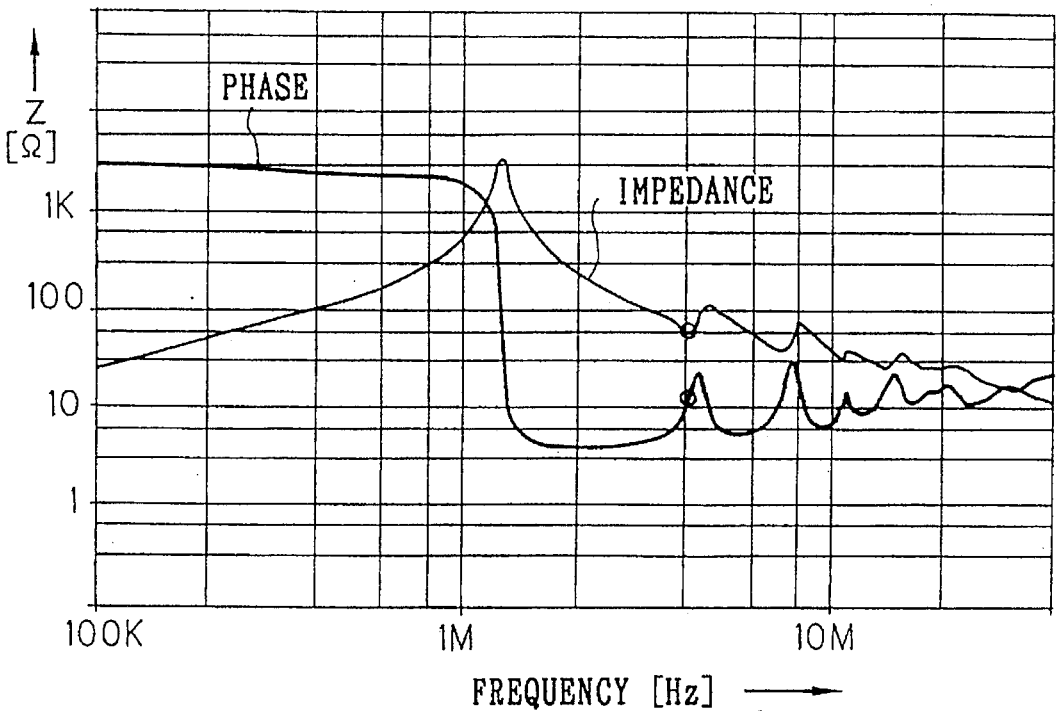
FIG. 2 shows an impedance characteristics of a horizontal deflection coil.
Figure 3:
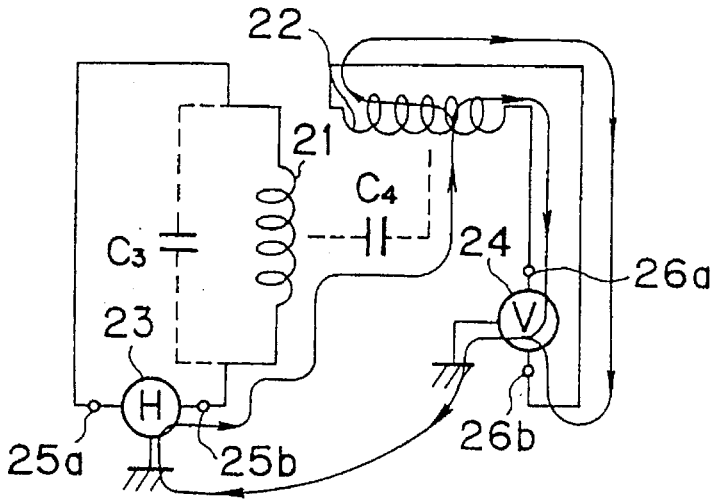
FIG. 3 is an equivalent circuit similar to that shown in FIG. 1, explaining a source of raster ringing.

As shown in FIG. 3, the horizontal deflection coil 21 has self-resonance points (corresponding to peak portions of the impedance characteristics shown in FIG. 2 whose primary resonance point is around 1.5 MHz) of a resonance circuit composed of an inductance of the coil 21 and a distributed capacitance C3 thereof which may be 15 to 30 pF. It has been found that this resonance frequency is related to the ringing frequency. Further, it has been found that the raster ringing is generated by mainly the fact that energy stored at the self resonance points of the horizontal deflection coil flows to the vertical deflection coil 22 through a capacitance C4 of about 100 pF between the horizontal deflection coil and the vertical deflection coil to produce a ringing magnetic field.

This fact will be described in more detail. Current flowing through the deflection yoke is changed drastically at a transient time from a retrace period to a display period during an image reproduction on a CRT. Energy stored in the horizontal deflection coil 21 is discharged thereby, so that the current flows to the vertical deflection coil 22 through the capacitance C4 between the horizontal deflection coil and the vertical deflection coil.

The latter current becomes a ringing current. In this case, a loop current path is formed from the horizontal deflection coil 21 through the capacitance C4, the vertical deflection coil 22, terminals 26*a* and 26*b* of the deflection yoke, a vertical drive circuit 24, a chassis ground of the vertical drive circuit 24, a chassis ground of a horizontal drive circuit 23, the horizontal drive circuit 23 and a terminal 25*b* of the deflection yoke back to the horizontal deflection coil 21.

The ringing magnetic field is formed when the ringing current flows through the vertical deflection coil 22 in the loop current path and frequency components around the self resonance points of the horizontal deflection coil 21 appear on the CRT screen as the raster ringing.

In view of this fact, the present inventors have figured out that such raster ringing can be prevented by returning the ringing current whose frequency component corresponds to the frequency component around the self resonance point of the coil 21, directly to the horizontal deflection coil without passing the vertical deflection coil.

Figure 1:
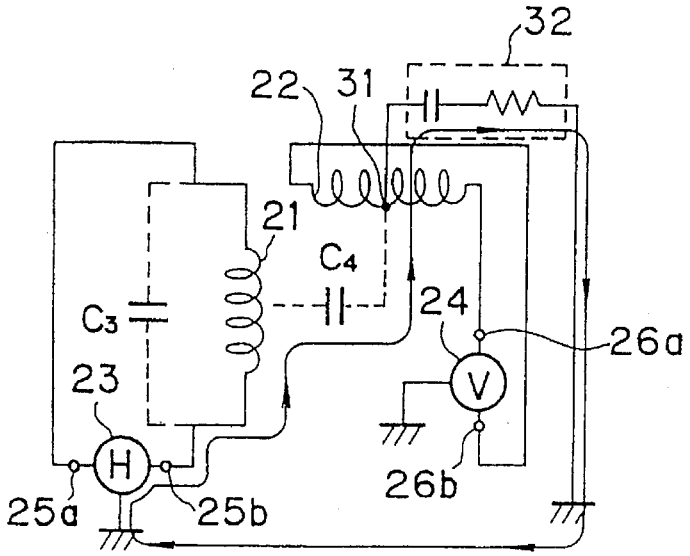
FIG. 1 is a diagram showing an equivalent circuit of a first embodiment of the present invention.
Figure 8:
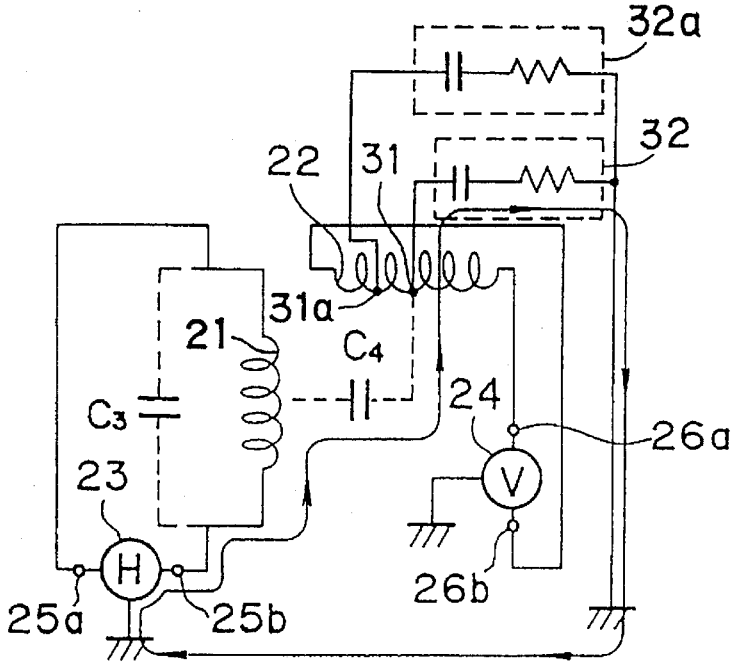
FIG. 8 is a diagram showing an equivalent circuit of a modified version of the first embodiment shown in FIG. 1.

FIG. 1 shows a deflection yoke according to a first embodiment of the present invention, and FIG. 8 shows a modified version of the first embodiment of the present invention. According to the first first embodiment of the present invention embodiment of the present invention, an intermediate tap 31 is provided on a vertical deflection coil 22 which may be the same as that of the conventional deflection yoke shown in FIG. 3 and is connected to a chassis ground through a high-pass filter (HPF) 32 which allows only the ringing current to pass.

Thus, a ringing current path which does not pass through the vertical deflection coil 22 is formed. This ringing current path is a loop from a horizontal deflection coil 21 through the capacitance C4, the intermediate tap 31, the HPF 32, the chassis ground, the same chassis ground for a horizontal drive circuit 23, the horizontal drive circuit 23 and a terminal 25*b* of the deflection yoke back to the horizontal deflection coil 21 as a current source. That is, since the current path is formed as such that it returns to the current source, it does not pass from the chassis ground of the HPF 32 through the chassis ground of the vertical drive circuit 24, the vertical drive circuit 24, a terminal 26*a* of the deflection yoke and the vertical deflection coil 22.

The vertical deflection current flowing through the vertical deflection coil 22 for vertical deflection, is a tooth wave of about 60 Hz and a maximum frequency component contained in the vertical deflection current is in the order of 1 to 2 kHz. On the other hand, a frequency component of the ringing current corresponds to the frequency component around the self resonance point of the horizontal deflection coil 21, which is over 1 MHz. Since the frequency of the ringing current is substantially higher than that of the vertical deflection current as mentioned, the HPF 32 for passing only the ringing current can be easily constructed with a simple electrical element such as resistor and a capacitor.

As described, the deflection yoke of the present invention can substantially reduce the raster ringing without affecting a normal vertical deflecting operation of the deflection yoke.

Figure 4:
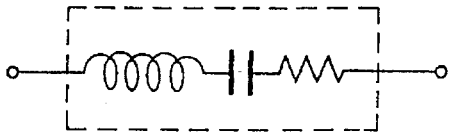
FIG. 4 is a circuit diagram of a band-pass filter.

The element to be provided between the intermediate tap 31 and the chassis ground is not limited to such HPF and a band-pass filter which may have such a simple construction as shown in FIG. 4, can be used therefor, so long as it allows only the ringing current to pass through while blocking the vertical deflection current.

In order to enhance the effect of flowing the ringing current to the ground, it is possible to provide a plurality of intermediate taps on the vertical deflection coil 22 and connect a corresponding number of elements each capable of passing only the ringing current between the chassis ground and the respective intermediate taps. An example of such circuit arrangement is shown in FIG. 8 in which an additional high-pass filter (HPF) 32*a* is connected between such an additional intermediate tap 31*a* and the chassis ground that is common. In this manner, a number of both the taps and the circuit element (HPF) may be increased more than 2.

Since the deflection yoke is generally of the current drive type, there is no terminal for chassis ground provided in the deflection yoke itself. Therefore, in order to ground as in the first embodiment shown in FIG. 1, there is necessary to provide a lead wire for chassis ground or a chassis ground terminal on the deflection yoke. Such provision of the lead wire or chassis ground terminal may lead to an increase of manufacturing cost thereof.

Figure 5:
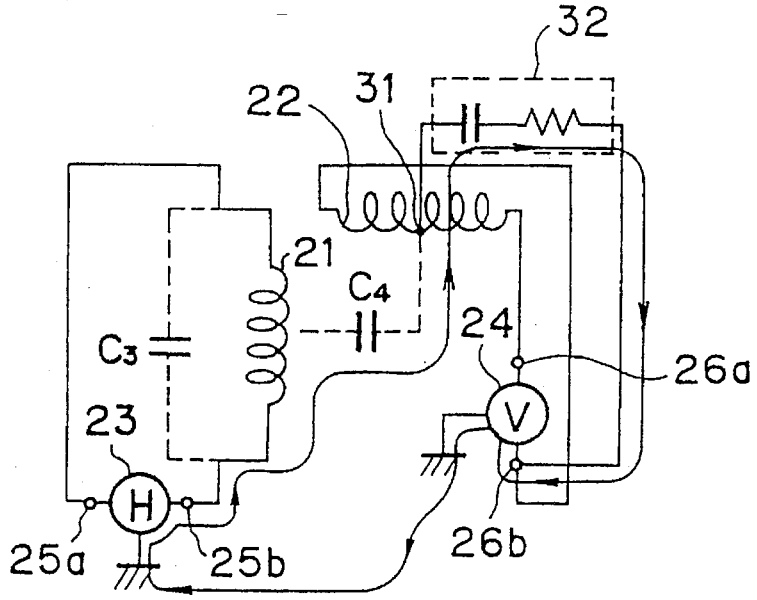
FIG. 5 is a diagram showing an equivalent circuit of a second embodiment of the present invention.
Figure 6:
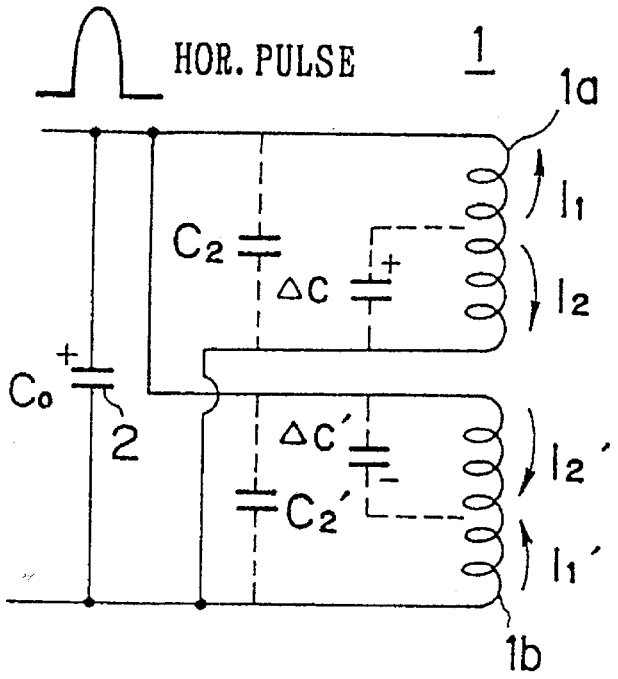
Fig.6 PRIOR ART
FIGS. 6 and 7 respectively show circuit constructions of prior arts for preventing raster ringing.
Figure 7:
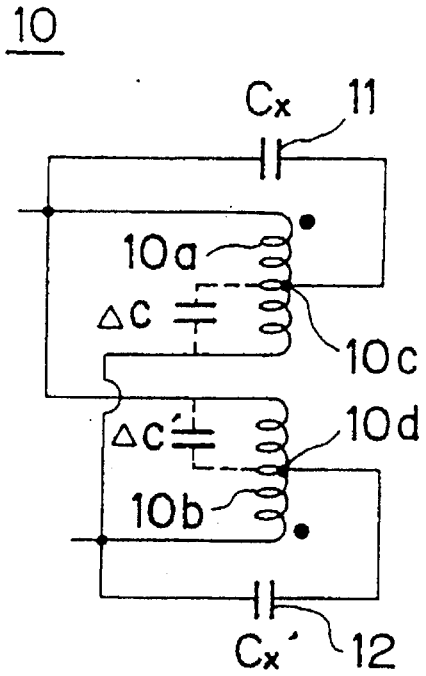
Fig.7 PRIOR ART
Figure 9:
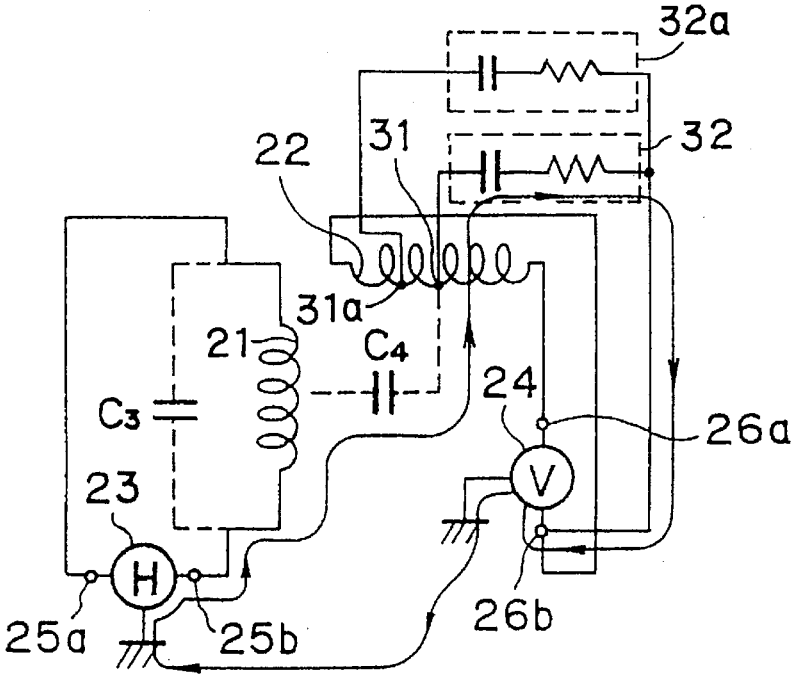
FIG. 9 is a diagram showing an equivalent circuit of a modified version of the second embodiment shown in FIG. 5.

FIG. 5 is a circuit diagram of a second embodiment which can avoid such an cost increase due to a provision of lead wire or chassis ground terminal. FIG. 9 shows a modified version of the second embodiment of the present invention. The second embodiments featured by connecting the HPF 32 between the intermediate tap 31 of the vertical deflection coil 22 and the cold side terminal 26*b* of the vertical deflection coil 22, unlike the first embodiment in which the HPF 32 is directly connected between the intermediate tap 31 and the chassis ground.

The vertical drive circuit 24 can be considered as being equivalent to the chassis ground for ringing current having frequency over 1 MHz. Therefore, in the second embodiment shown in FIG. 5, a current path for the ringing current which does not pass through the vertical deflection coil 22 is formed as shown by an a loop indicated with an arrow, resulting in the same effect as obtained by the first embodiment.

It is, of course, possible to connect the HPF 32 not between the intermediate tap 31 of the vertical deflection coil 22 and the cold side terminal 26*b* of the vertical deflection coil 22 but between the intermediate tap 31 and the hot side terminal 26*a* of the vertical deflection coil 22. Further, in the second embodiment, it is also possible to provide a plurality of intermediate taps on the vertical deflection coil 22 and connect a corresponding number of filtering elements each capable of passing only the ringing current between the hot or cold side terminal of the vertical deflection coil 22 and the respective intermediate taps. An example of such circuit arrangement is shown in FIG. 9 in which an additional high-pass filter (HPF) 32*a* is connected between the additional intermediate tap 31*a* and the hot or the cold side terminal of the vertical deflection coil 22. In this manner, a number of both the taps and the circuit element (HPF) may be increased more than 2.

As described hereinbefore, the deflection yoke according to the present invention can return the ringing current which, otherwise, flows from the horizontal deflection coil 21 into the vertical deflection coil 22 through the capacitance between the horizontal and vertical deflection coils, directly to the side of the horizontal deflection coil. Therefore, it is possible to substantially reduce the raster ringing to thereby prevent an image quality from degrading.

Further, since the ringing current is returned to the horizontal deflection coil through the filtering element which can pass only the ringing current, it is possible to substantially reduce the raster ringing without an adverse effect on the vertical deflecting operation of the deflection yoke.

In addition thereto, when such filtering element is connected between the intermediate tap of the vertical deflection coil and the hot or cold terminal of the vertical deflection coil, there is no need of providing an additional lead wire for connection to the chassis ground or the chassis ground terminal, preventing the manufacturing cost from increasing.

What is claimed is:

1. A deflection yoke including a horizontal deflection coil and a vertical deflection coil, comprising:

at least one intermediate tap provided on said vertical deflection coil; and circuit element means provided only between said intermediate tap and a hot terminal of said vertical deflection coil for allowing current to pass having a frequency component higher than a maximum frequency component of vertical deflection current flowing through said vertical deflection coil.

2. A deflection yoke including a horizontal deflection coil and a vertical deflection coil, comprising:

at least one intermediate tap provided on said vertical deflection coil; and circuit element means provided only between said intermediate tap and a cold terminal of said vertical deflection coil for allowing current to pass having a frequency component higher than a maximum frequency component of vertical deflection current flowing through said vertical deflection coil.

3. A deflection yoke including a horizontal deflection coil and a vertical deflection coil comprising:

a plurality of intermediate taps provided on said vertical deflection coil; and a plurality of frequency dependent networks being connected respectively to said plurality of intermediate taps and commonly to a hot terminal of said vertical deflection coil, each of said plurality of frequency dependent networks being capable of passing a current having a frequency component higher than a maximum frequency component of vertical deflection current flowing through said vertical deflection coil.

4. A deflection yoke including a horizontal deflection coil and a vertical deflection coil comprising:

a plurality of intermediate taps provided on said vertical deflection coil; and a plurality of frequency dependent networks being connected respectively to said plurality of intermediate taps and commonly to a cold terminal of said vertical deflection coil, each of said plurality of frequency dependent networks being capable of passing a current having a frequency component higher than maximum frequency component of vertical deflection current flowing through said vertical deflection coil.

5. A deflection yoke including a horizontal deflection coil and a vertical deflection coil comprising:

first and second intermediate taps provided on said vertical deflection coil; and first and second frequency dependent networks each having first and second terminals and being capable of passing a current having a frequency component higher than a maximum frequency component of vertical deflection current flowing through said vertical deflection coil, wherein said first terminal of said first frequency dependent network and said first terminal of said second frequency dependent network are respectively connected to said first and second intermediate taps, and said second terminal of said first frequency dependent network and said second terminal of said second frequency dependent network are commonly connected to a hot terminal of said vertical deflection coil.

6. A deflection yoke including a horizontal deflection coil and a vertical deflection coil comprising:

first and second intermediate taps provided on said vertical deflection coil; and first and second frequency dependent networks each having first and second terminals and being capable of passing a current having a frequency component higher than a maximum frequency component of vertical deflection current flowing through said vertical deflection coil, wherein said first terminal of said first frequency dependent network and said first terminal of said second frequency dependent network are respectively connected to said first and second intermediate taps, and said second terminal of said first frequency dependent network and said second terminal of said second frequency dependent network are commonly connected to a cold terminal of said vertical deflection coil.

* * * * *